United States Patent [19]

Shimizu et al.

[11] 4,212,689

[45] Jul. 15, 1980

[54] METHOD FOR PRODUCING GRAIN-ORIENTED ELECTRICAL STEEL SHEETS OR STRIPS HAVING A VERY HIGH MAGNETIC INDUCTION

[75] Inventors: Yoh Shimizu, Chiba; Yoshiaki Iida, Kobe; Tomomichi Goto, Chiba; Hiromi Mitsunori, Chiba; Isao Matoba, Chiba, all of Japan

[73] Assignee: Kawasaki Steel Corporation, Kobe, Japan

[21] Appl. No.: 792,579

[22] Filed: May 2, 1977

Related U.S. Application Data

[63] Continuation-in-part of Ser. No. 552,223, Feb. 24, 1975, abandoned.

[30] Foreign Application Priority Data

Feb. 28, 1974 [JP] Japan ..... 49-22861

[51] Int. Cl.[2] ..... H01F 1/04

[52] U.S. Cl. ..... 148/111; 148/31.55; 148/113; 75/123 L

[58] Field of Search ..... 148/111, 112, 31.55, 148/110, 113; 75/123 L

[56] References Cited

U.S. PATENT DOCUMENTS

| | | | |
|---|---|---|---|
| 3,345,219 | 10/1967 | Detert | 148/112 |
| 3,671,337 | 6/1972 | Kumai et al. | 148/111 |
| 3,905,843 | 9/1975 | Fiedler | 148/111 |
| 3,940,299 | 2/1976 | Goto et al. | 148/111 |

*Primary Examiner*—L. Dewayne Rutledge
*Assistant Examiner*—John P. Sheehan

[57] ABSTRACT

A grain-oriented electrical steel sheet having a very high magnetic induction is obtained by developing secondary recrystallized grains at a specifically limited secondary recrystallization temperature in a cold rolled silicon steel sheet containing substantially no antimony and aluminum and having a specifically limited low nitrogen content.

7 Claims, 5 Drawing Figures

METHOD FOR PRODUCING GRAIN-ORIENTED ELECTRICAL STEEL SHEETS OR STRIPS HAVING A VERY HIGH MAGNETIC INDUCTION

This application is a continuation-in-part of application Ser. No. 552,223, filed by Feb. 24, 1975 and now abandoned.

The present invention relates to a method for producing so-called grain-oriented electrical steel sheets or strips having an easy magnetization axis <100> in the rolling direction and a [110] plane parallel to the rolling plane, and more particularly relates to a method for producing grain-oriented electrical steel sheets or strips having a very high magnetic induction $B_8$.

The grain-oriented electrical steel sheets are mainly used as a transformer core and other electrical devices, and are required to have a high magnetic induction and a low iron loss.

It is commonly known that the improvement of the magnetic properties is not only effective to make the size of the transformer small, but also effective to decrease the magnetostriction which causes a noise of the transformer in magnetized state. The magnetic properties are generally evaluated by the $B_8$ value, that is, the magnetic induction wb/m$^2$ at the magnetic field of 800 A/m. Electrical steel sheets having a $B_8$ value of more than 1.88 wb/m$^2$ can be produced by the recent techniques. These techniques are disclosed in U.S. Pat. No. 3,841,924 which uses AlN, and other literatures.

While, the applicant has already proposed a method which can attain the above described object by using proper amounts of Sb and at least one of Se and S as an inhibitor and by developing secondary recrystallized grains at a relatively low temperature in the final annealing step (U.S. Pat. No. 3,932,234).

However, Sb is remarkably effective for improving the magnetic induction of aimed final product, but is apt to cause hot shortness during hot rolling, particularly during the water cooling carried out in the hot rolling step, due to the segregation of Sb on the grain boundary of the slab prior to hot rolling. Moreover, Sb deteriorates the forsterite ceramic coating formed in the final annealing of a cold rolled sheet and lowers the adhesion of the coating, which is commonly estimated by the adhesion at bending.

The object of the present invention is to provide a method for producing grain-oriented electrical steel sheets having a very high magnetic induction without use of Sb having such drawbacks, and can be attained by decreasing the content of nitrogen and that of nitride-forming elements, such as aluminum, vanadium, tantalum and the like, of the cold rolled steel sheet before the final annealing in fundamentary the same method as that disclosed in U.S. Pat. No. 3,932,234, except that Sb is not contained in the cold rolled steel sheet.

The essential feature of the present invention lies in a method for producing grain-oriented electrical steel sheets or strips having a very high magnetic induction, in which a silicon steel raw material composed of not more than 0.06% of C, 2.0–4.0% of Si, 0.01–0.20% of Mn, 0.005–0.10% of a total amount of at least one of S and Se and the remainder being Fe is hot rolled to a thickness of 2–5 mm, the hot rolled sheet is subjected repeatedly to annealings and cold rollings to prepare a cold rolled sheet having a final gauge of 0.1–0.5 mm, the cold rolled sheet is subjected to a decarburization annealing to decrease the carbon content to not more than 0.005%, and then the decarburized sheet is subjected to a series of final annealing consisting of a step for developing fully secondary recrystallized grains having (110)[001] orientation at a temperature of 800°–900° C. and a step for effecting a purification annealing at a temperature of not lower than 1,000° C., the improvement which comprises said cold rolled sheet being composed of not more than 0.06% of C., 2.0–4.0% of Si, 0.01–0.20% of Mn, 0.005–0.10% of a total amount of at least one of S and Se and the remainder being substantially Fe, and containing substantially no Sb and Al, and not more than 0.0045% of N.

The term "the cold rolled sheet containing substantially no Sb and Al" means that each amount of Sb and Al contained in the sheet is limited to not more than 0.004%, preferably not more than 0.002%.

It has been known that, regarding to the nitrogen content in the final product of electrical steel sheet, it is required to be as low as possible in order to decrease the iron loss. For example, U.S. Pat. No. 3,867,211 and U.S. Pat. No. 3,435,537 also disclose such technique. On the other hand, as disclosed in U.S. Pat. No. 2,802,761, at least 0.01% of nitrogen is utilized as an inhibitor in the secondary recrystallization, and further various nitrides have been known as an inhibitor. For example, in the above described U.S. Pat. No. 3,841,924, AlN is utilized; in U.S. Pat. No. 3,184,346, VN is utilized; and in other prior arts, TaN is utilized. Of course, in these methods, nitrogen must be finally removed during the high temperature annealing in hydrogen atmosphere, although certain amount of nitrogen is necessary in a cold rolled sheet before the high temperature annealing. On the contrary, the present invention aims to produce electrical steel sheets having a very high magnetic induction by a combination of the conditions that (1) the nitrogen content in a cold rolled sheet before the final annealing for developing secondary recrystallized grains is limited to not more than 0.0045%, preferably not more than 0.0025%, and (2) secondary recrystallized grains are developed at a temperature of 800°–900° C.

For a better understanding of the invention, reference is taken to the accompanying drawings, wherein.

Figure 4:
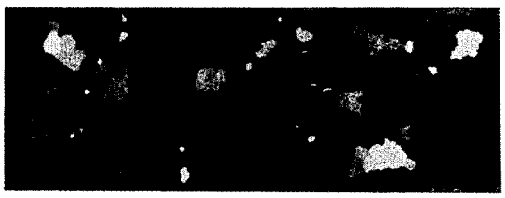
Figure 5:
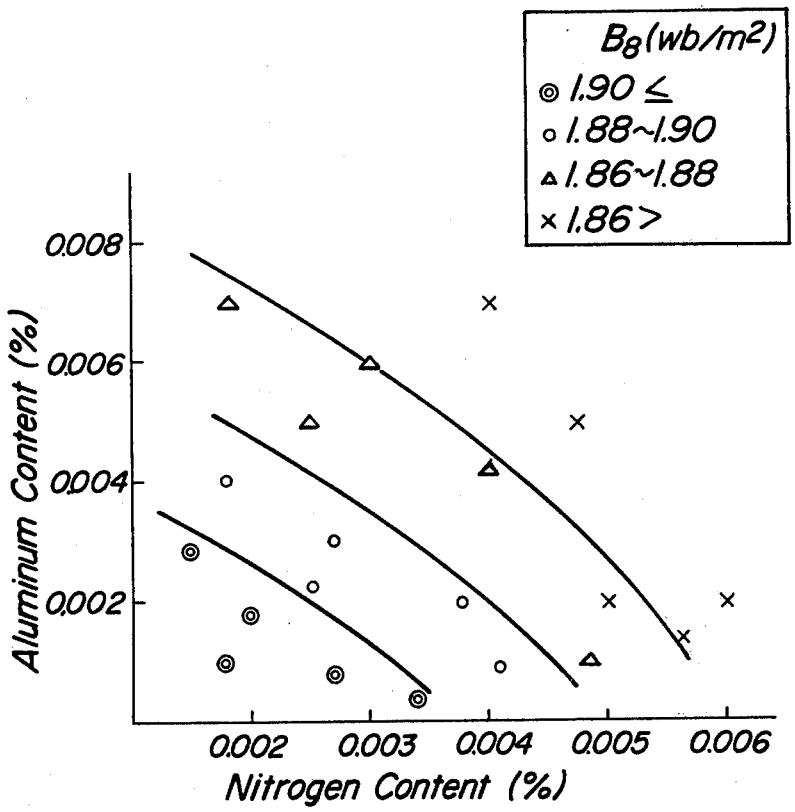

FIG. 4 is a photograph showing a macrostructure of a final product obtained by subjecting a cold rolled sheet having a low nitrogen content (N=0.0025%), which is within the scope of the present invention, to a final annealing; and FIG. 5 is a graph showing an influence of the nitrogen content (%) and aluminum content (%) of a cold rolled sheet before the secondary recrystallization annealing upon the $B_8$ value of final products (secondary recrystallization temperature: 840° C.).

Figure 1:
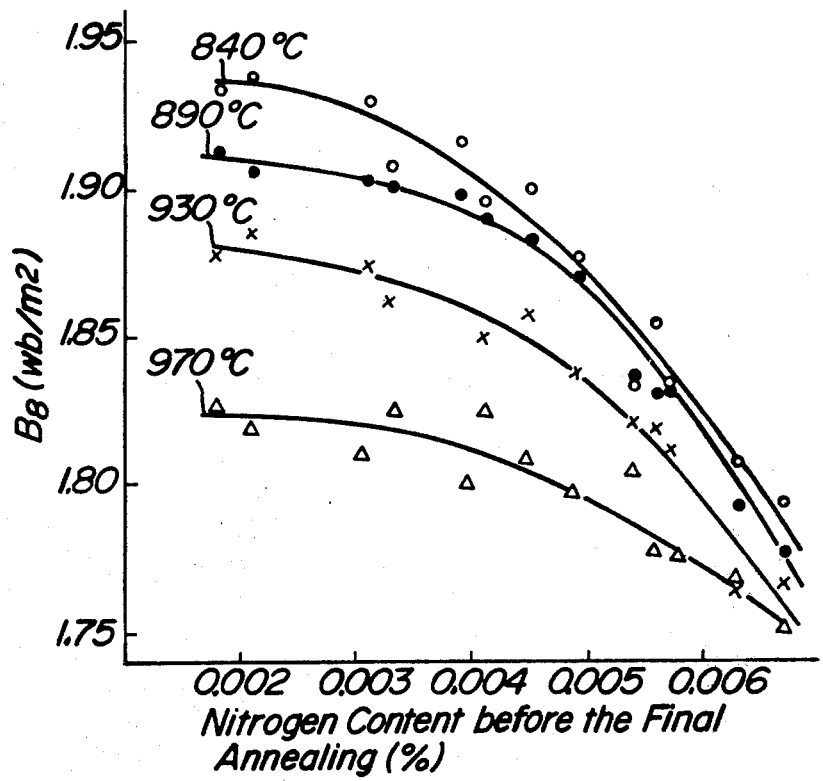
FIG. 1 is a graph showing a relation between the nitrogen content (%) of a cold rolled sheet before the final annealing and the $B_8$ value (wb/m$^2$) of the final product at various temperatures for developing secondary recrystallized grains (hereinafter, the temperature for developing secondary recrystallized grains is referred to as "secondary recrystallization temperature")

FIG. 1 shows the influence of the nitrogen content in the cold rolled sheet before the final annealing, which has a composition of 2.8–3.2% of Si, not more 0.005% of C, 0.04–0.12% of Mn, 0.008–0.02% of a total amount of S and Se, not more than 0.001% of Al, trace of Sb and the remainder being Fe upon the $B_8$ value of the final product at various secondary recrystallization temperatures. It is clear from FIG. 1 that, as the nitrogen content is lower, the $B_8$ value is higher. When the nitrogen content is not more than 0.0045%, the $B_8$ value exceeds 1.88 wb/m$^2$, and when the nitrogen content is not more than 0.0025%, the $B_8$ value exceeds 1.90 wb/m$^2$ at a secondary recrystallization temperature of not higher than 890° C.

Figure 2:
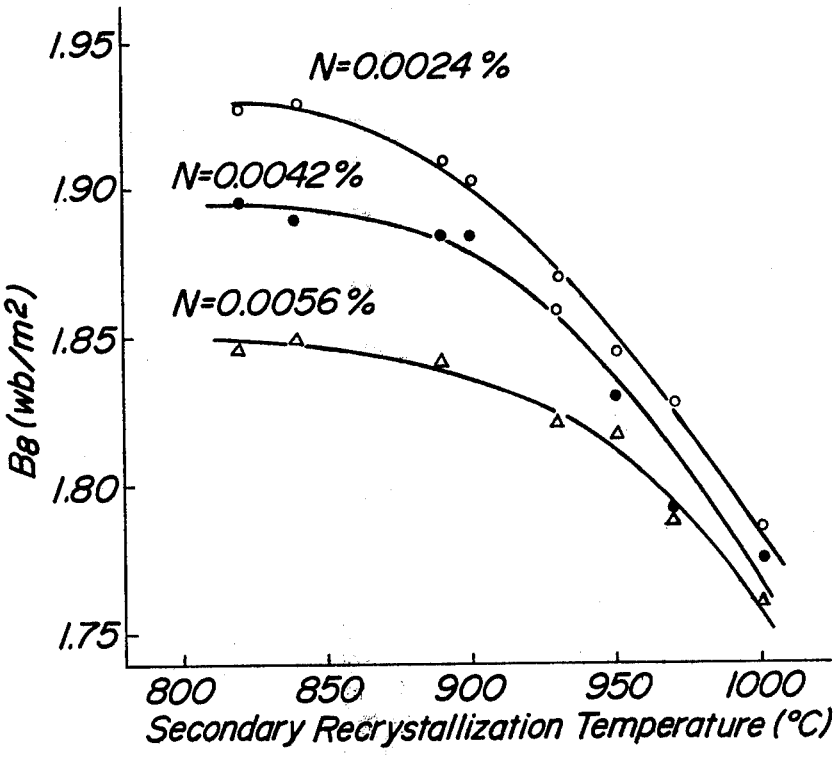
FIG. 2 is a graph showing a relation between the secondary recrystallization temperature of a cold rolled sheet and the $B_8$ value (wb/m$^2$) of the final product at various nitrogen contents in the cold rolled sheet.

FIG. 2 shows that the secondary recrystallization temperature has a high influence upon the $B_8$ value. It is clear from FIG. 2, when the secondary recrystallization temperature is not higher than 900° C. and further the nitrogen content in the cold rolled sheet is as low as not higher than 0.0042%, the $B_8$ value exceeds 1.88 wb/m$^2$.

Figure 3:
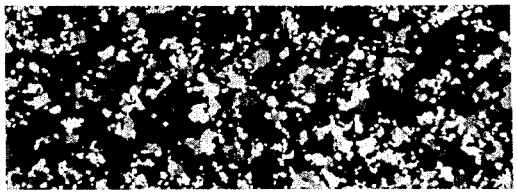
FIG. 3 is a photograph showing a macrostructure of a final product obtained by subjecting a cold rolled sheet having a high nitrogen content (N=0.0063%), which is outside the scope of the present invention, to a final annealing.

The macrostructure of the final product has an intimate relation to the $B_8$ value thereof. When the nitrogen content in the cold rolled sheet is high (for example, N=0.0063%), the macrostructure of the final product after the final annealing becomes a heterogeneous grain structure containing many island grains as shown in FIG. 3, and the selectivity to (110)[001] orientation is low as a whole. While, when the nitrogen content is low (for example, N=0.0025%), the macrostructure of the final product does not substantially show a heterogeneous structure as shown in FIG. 4.

The reason why such a heterogeneous structure is formed has not yet been clarified, but is probably as follows. $Si_3N_4$ and other nitrides, which are analyzed as acid-insoluble nitrogen in the total nitrogen of a silicon steel, disturb the grain boundary inhibition effect of MnS, MnSe and the like, and as the result, the heterogeneous structure is formed without the formation of perfect secondary recrystallized structure. This phenomenon can be guessed from the fact that the secondary recrystallization temperature (800°–900° C.), which is one of the necessary requirements of the present invention, agrees with the temperature range, wherein $Si_3N_4$ is present in a stable form. That is, when it is intended to develop secondary recrystallized grains at 800°–900° C., the nitrogen content of a cold rolled sheet must be very low, and if the nitrogen content is not limited to not more than 0.0045%, the adverse affect of nitrides on the development of secondary recrystallized grains appears, and satisfactory final products cannot be obtained.

The inventors have already proposed a method, wherein a silicon steel containing Sb is used and secondary recrystallized grains are developed at a temperature of 800°–900° C. In this method, the adverse affect of nitrogen does not appear. This is probably due to the fact that the adverse affect of nitrogen is inhibited by Sb.

In the present invention, both the amount of N and that of Al contained in a silicon steel raw material are limited, and it is necessary that the silicon steel raw material does not substantially contain N and Al. The reason is that, when Al is present in a silicon steel, AlN affects adversely the secondary recrystallization step of the present invention to deteriorate the magnetic properties of the final product.

FIG. 5 is a graph illustrating an influence of the amounts of Al and N contained in a cold rolled sheet having a final gauge before the sheet is subjected to a final annealing including the secondary recrystallization step, upon the magnetic property of the final product. P That is, in the experiment shown in FIG. 5, cold rolled sheets having a final gauge, which had been subjected to a decarburization annealing and were composed of 2.8–3.2% of Si, not more than 0.005% of C, 0.04–0.12% of Mn, 0.008–0.02% of a total amount of S and Se, trace of Sb, predetermined amounts of Al and N, and the remainder being substantially Fe were subjected to a secondary recrystallization annealing at a temperature of 840° C., and a relation between the $B_8$ value of the final products and the amounts of Al and N contained in the cold rolled sheets before the secondary recrystallization annealing was examined.

It can be seen from FIG. 5 that final products having a high $B_8$ value can be obtained only when Al is not substantially contained in the cold rolled sheet and N content of the sheet is low.

The present invention will be explained in more detail in order of the treating steps hereinafter.

The silicon steel raw material to be used in the present invention may be substantially Sb- and Al-free silicon steels composed of not more than 0.06% of C, 2.0–4.0% of Si, 0.01–0.20% of Mn, 0.005–0.10% of a total amount of at least one of S and Se as an inhibitor for primary recrystallized grains, and the remainder being substantially Fe. The steel ingot may be produced by any means. For example, the steel ingot may be produced by a continuous casting process. The steel ingot is hot rolled to prepare a hot rolled steel strip having a thickness of about 2–4 mm by a conventional means. The hot rolled steel strip is subjected to at least one time of cold rolling to prepare a cold rolled sheet having a final gauge. In this case, annealing at 800°–1,000° C. carried out prior to the cold rolling which yields a sheet of final gauge, is preferably effected in order to homogenize the crystal structure of the cold rolled sheet, if necessary. The cold rolled sheet having a final gauge is then subjected to a decarburization annealing at 700°–900° C. in wet hydrogen to decrease the carbon content to not more than 0.005%.

After the decarburization annealing, the cold rolled sheet is applied with an annealing separator consisting mainly of MgO, taken up in the form of a coil and subjected to a high temperature annealing for secondary recrystallization and for the purification. In the present invention, it is necessary that the nitrogen content in the cold rolled sheet before this high temperature annealing, that is, after the decarburization annealing, must be limited to not more than 0.0045%, preferably not moe than 0.0025%.

In order to obtain a cold rolled sheet having a nitrogen content within the above described range, it is necessary to carry out the refining and casting of a steel raw material so as to obtain a steel having a sufficiently low nitrogen content, and further it is necessary to take care of the atmosphere of the annealing step carried out between the cold rolling steps.

It is necessary that secondary recrystallized grains are fully developed at 800°–900° C. in the final annealing based on the above described reason. Means for developing secondary recrystallized grains is not particularly limited, but when the secondary recrystallization temperature is kept at a certain temperature within the range of 800°–900° C. for 10–80 hours or raised gradually at a rate of 0.5°–10° C./hr within the above described temperature range, a preferable result can be obtained. Moreover, it is necessary to take care that the nitriding of the steel sheet from the annealing atmosphere does not occur until secondary recrystallized grains are fully developed.

Following to the step for developing the secondary recrystallized grains at 800°–900° C., a high temperature annealing for purification is carried out at a temperature of not lower than 1,000° C. It is preferable to effect this high temperature annealing in dry hydrogen.

The following examples are given for the purpose of illustration of this invention.

EXAMPLE 1

Three kinds of 10 ton silicon steel ingots, each containing 0.025% of C, 3.05% of Si, 0.060% of Mn, 0.001% of Sb, 0.001% of Al and 0.025% of Se and further containing 0.0025%, 0.0045% or 0.0058% of N, which is an analytical value before the final annealing, were produced. The steel ingot containing 0.0025% of N, that containing 0.0045% of N and that containing 0.0058% of N are referred to as samples A, B and C, respectively.

Each of the three kinds of steel ingots was heated niformly at 1,280° C. for 5 hours and subjected to slabbing to prepare a slab having a thickness of 180 mm. The slab was heated at 1,280° C. for 1.5 hours, hot rolled to a thickness of 3.0 mm, annealed at 950° C. for 10 minutes, and subjected to a first cold rolling at a cold rolling rate of 75% to a thickness of 0.75 mm, to an intermediate annealing at 900° C. for 10 minutes under hydrogen atmosphere, to a second cold rolling at a cold rolling rate of 60% to a final gauge of 0.30 mm, and then to a decarburization annealing at 800° C. for 10 minutes in wet hydrogen having a dew point of 60° C. Each of the decarburized samples A, B and C was applied with an annealing sepearator consisting mainly of magnesia (MgO) and then subjected to final annealings under the following three conditions.

(I) In hydrogen, at 830° C. for 100 hours, and then at 1,200° C. for 10 hours.

(II) In hydrogen, at 900° C. for 30 hours, and then at 1,200° C. for 10 hours.

(III) In hydrogen, at 950° C. for 30 hours, and then at 1,200° C. for 10 hours (Comparative Example).

The $B_8$ (wb/m$^2$) values and $W_{17/50}$ (w/kg) values of the above treated samples A, B and C are shown in the following Table 1.

Table 1

| Sample No. | N content (%) | $B_8$(wb/m$^2$) | $W_{17/50}$(w/kg) | Remarks |
|---|---|---|---|---|
| AI | | 1.94 | 1.05 | |
| AII | 0.0025 | 1.89 | 1.10 | |
| AIII | | 1.84 | 1.16 | Comparative Example |
| BI | | 1.90 | 1.12 | |
| BII | 0.0045 | 1.88 | 1.18 | |
| BIII | | 1.82 | 1.23 | Comparative Example |
| CI | | 1.83 | 1.26 | |
| CII | 0.0058 | 1.80 | 1.29 | |
| CIII | | 1.78 | 1.35 | Comparative Example |

It can be seen from Table 1 that sample A having the lowest nitrogen content has best $B_8$ value and $W_{17/50}$ value as compared with samples B and C in the case when they are treated under the same final annealing condition. Further, in each group of samples A, B and C, a sample treated under the final annealing condition I, under which a final annealing is effected at a lowest temperature (830° C.) for a long period of time (100 hrs.), has best $B_8$ value and $W_{17/50}$ value.

EXAMPLE 2

Eight kinds of 8 ton silicon steel ingots containing 0.025–0.032% of C, 2.90–3.08% of Si, 0.070–0.082% of Mn, and 0.020–0.028% of S were produced. The N, Al and Sb contents of the steel ingots are shown in the following Table 2. Each of the steel ingots was subjected to a hot rolling and a cold rolling in the same manner as described in Example 1 to produce a cold rolled steel sheet having a final gauge of 0.30 mm. The cold rolled steel sheet was subjected to a decarburization annealing at 800° C. for 10 minutes in wet hydrogen atmosphere. The decarburized sheet was applied with MgO, subjected to a secondary recrystallization annealing at 850° C. for 30 hours, and then subjected to a purification annealing at 1,200° C. for 5 hours in hydrogen atmosphere.

The magnetic properties of the final products and the adhesion of the coating are shown in Table 2. In Table 2, the adhesion of a coating is estimated by the critical radius of a steel rod, which does not cause exfoliation of the coating when a steel sheet having the coating thereon is bend around the steel rod.

It can be seen from the results of Examples 1 and 2 that, according to the present invention, grain-oriented electrical steel sheets or strips, which are excellent in the magnetic property and have a coating having a high adhesion, can be obtained.

Table 2

| Steel ingot No. | N(%) | Al(%) | Sb(%) | Secondary recrystallization annealing temperature (°C.) | $B_8$ (T) | $W_{17/50}$ (w/kg) | Adhesion* at bending | Remarks |
|---|---|---|---|---|---|---|---|---|
| 1 | 0.0022 | 0.002 | 0.003 | 850 | 1.925 | 1.04 | O | Present invention |
| 2 | 0.0025 | 0.008 | 0.002 | 850 | 1.875 | 1.20 | O | Comparative Example |
| 3 | 0.0038 | 0.001 | 0.002 | 850 | 1.898 | 1.13 | O | Present invention |
| 4 | 0.0038 | 0.007 | 0.003 | 850 | 1.871 | 1.25 | O | Comparative Example |
| 5 | 0.0048 | 0.001 | 0.002 | 850 | 1.870 | 1.19 | O | Comparative Example |
| 6 | 0.0048 | 0.002 | 0.035 | 850 | 1.895 | 1.17 | Δ | Comparative Example |

Table 2-continued

| Steel ingot No. | N(%) | Al(%) | Sb(%) | Secondary recrystallization annealing temperature (°C.) | $B_8$ (T) | $W_{17/50}$ (w/kg) | Adhesion* at bending | Remarks |
|---|---|---|---|---|---|---|---|---|
| 7 | 0.0055 | 0.002 | 0.002 | 850 | 1.832 | 1.27 | O | Comparative Example |
| 8 | 0.0056 | 0.003 | 0.065 | 850 | 1.878 | 1.22 | X | Comparative Example |

Note:
*Critical radius of a steel rod which does not cause exfoliation of coating.
O ≦ 30 mm
Δ 40–50 mm
X ≧ 60 mm

What is claimed is:

1. In a method for producing grain-oriented electrical steel sheets or strips having a very high magnetic induction, in which method a forsterite ceramic coating is deposited on a sheet of silicon steel raw material composed of not more than 0.06% of C, 2.0–4.0% of Si, 0.01–0.20% of Mn, 0.005–0.10% of a total amount of at least one of S and Se and the remainder being Fe, the sheet of silicon steel raw material is hot rolled to a thickness of 2–5 mm, the hot rolled sheet is subjected repeatedly to annealings and cold rollings to prepare a cold rolled sheet having a final gauge of 0.1–0.5 mm, the cold rolled sheet is subjected to a decarburization annealing to decrease the carbon content to not more than 0.005%, and then the decarburized sheet is subjected to a series of final annealing steps, the improvement which comprises the cold rolled sheet containing substantially no Sb and Al, prior to being subjected to the final annealing steps, so as to prevent the deterioration of the forsterite ceramic coating formed on the sheet during the final annealing steps, the cold rolled sheet consisting of not more than 0.06% of C, 2.0–4.0% of Si, 0.01–0.20% of Mn, 0.005–0.10% of a total amount of at least one of S and Se and the remainder being substantially Fe, and containing not more than 0.0045% of N, and the final annealing steps consisting of a step for developing in the sheet fully secondary recrystallized grains, having (110) [001] orientation at a temperature of 800°–900° C., and a step for effecting a purification annealing of the sheet at a temperature of not lower than 1,000° C., so as to form a highly adhesive ceramic coating on the surface of the sheet.

2. The method according to claim 1, wherein said nitrogen content is limited to not more than 0.0025%.

3. The method according to claim 1, wherein the secondary recrystallized grains are developed at a certain temperature within the range of 800°–900° C. for 10–80 hours.

4. The method according to claim 1, wherein the secondary recrystallized grains are developed by raising gradually the temperature at a rate of 0.5°–10° C./hr within the range of 800°–900° C.

5. The method according to claim 1, wherein each amount of Sb and Al contained in the sheet is limited to not more than 0.004%.

6. The method according to claim 1, wherein each amount of Sb and Al contained in the sheet is limited to not more than 0.002%.

7. The method according to claim 1, wherein the final annealing step for developing fully secondary recrystallized grains is effected at a temperature of 830° C. for 100 hours.

* * * * *